United States Patent [19]

Dannert et al.

[11] Patent Number: 4,714,862

[45] Date of Patent: Dec. 22, 1987

[54] CIRCUIT ARRANGEMENT FOR IGNITING AND OPERATING GAS DISCHARGE LAMPS

[75] Inventors: Horst Dannert, Aachen; Hans-Günther Ganser, Stolberg; Ralf Schäfer, Aachen; Hans-Peter Stormberg, Stolberg, all of Fed. Rep. of Germany

[73] Assignee: U.S. Philips Corporation, New York, N.Y.

[21] Appl. No.: 787,394

[22] Filed: Oct. 15, 1985

[30] Foreign Application Priority Data

Oct. 17, 1984 [DE] Fed. Rep. of Germany ..... 3438002

[51] Int. Cl.[4] ..... H05B 37/00

[52] U.S. Cl. ..... 315/244; 315/290

[58] Field of Search ..... 315/290, 244, 104

[56] References Cited

U.S. PATENT DOCUMENTS

| | | | |
|---|---|---|---|
| 2,717,337 | 9/1955 | Laird | 315/244 |
| 3,586,817 | 6/1971 | Manz | 315/244 |
| 4,210,850 | 7/1980 | Britton | 315/244 |
| 4,553,072 | 11/1985 | Frattisek et al. | 315/244 |

*Primary Examiner*—David K. Moore

*Attorney, Agent, or Firm*—Robert T. Mayer; Bernard Franzblau

[57] ABSTRACT

A circuit arrangement for igniting and operating gas discharge lamps comprises a choke coil (1) connected between a lamp (2) and an a.c. supply source. The choke coil has an inductance L and an ignition device (3) is connected to the lamp. A capacitor (9) having a capacitance C is connected in parallel with at least a part of the choke coil in order to pass an ignition current to the lamp that is higher than the normal lamp operating current. The relationship betweeen the capacitive reactance of the capacitor and the inductive reactance of the choke coil is $1/\omega C > 3\omega L$.

11 Claims, 5 Drawing Figures

CIRCUIT ARRANGEMENT FOR IGNITING AND OPERATING GAS DISCHARGE LAMPS

BACKGROUND OF THE INVENTION

This invention relates to a circuit arrangement for igniting and operating gas discharge lamps having a choke coil arranged between the lamp and the a.c. supply source and having an inductance L and an ignition device connected to the lamp. A capacitor having a capacitance C is connected in parallel with at least a part of the choke coil in order to obtain an ignition current that is higher than the normal lamp operating current.

In the operation of gas discharge lamps, problems frequently occur during the ignition process. This ignition process comprises three stages, i.e. a primary ionization of the discharge path, designated as breakdown, a subsequent low-current glow discharge between the lamp electrodes and the succeeding passage from the flow discharge to the actual high-current arc discharge. A frequently occurring cause of ignition difficulties is then a non-stable passage from the glow discharge to the arc discharge. In lamps having, for example, an amalgam filling, such as sodium high-pressure lamps filled with an Na/Hg amalgam, in the event of an unfavourable amalgam distribution in the discharge vessel, the discharge is applied to the amalgam instead of to the electrodes. As a result, the passage from the glow discharge to the arc discharge is made more difficult and the lamp remains in the glow stage, i.e. the ignition has failed. Similar problems arise with the re-ignition of still hot lamps. In this case, the effect frequently occurs that the passage from the glow discharge to the arc discharge takes place transiently, i.e. for a small part of an a.c. half cycle and then a change-over is effected again to a glow discharge.

By means of so-called heterodyne igniters, cold gas discharge lamps can be reliably ignited and still hot lamps can be readily reignited (see DE-OS Nos. 3108547 and 3108548 as well as U.S. Pat. No. 3,944,876). These known ignition circuits produce ignition pulses between 2 and 5 kV and 7 and 15 kV, respectively. The use of these circuits as external igniters for discharge lamps, which are to be provided, for example as an alternative to incandescent lamps with an E-27 cap, is not possible because the permissible voltage values prescribed for the E-27 cap are exceeded. Therefore, this application makes it necessary to accommodate the ignition circuits in the lamp base. However, this is made more difficult by the fact that the required capacitors are comparatively large and hence make it more difficult to obtain a compact lamp construction. Moreover, in the circuits according to the said DE-OS, even when they are accommodated in the lamp base, under given operating conditions voltages may still occur between the cap contacts which exceed the permissible values for the E-27 cap. Furthermore, with the use of the known ignition circuits in sodium high-pressure lamps at an elevated sodium pressure for improving the colour properties, it has been found that a direct restarting of the hot lamps, especially at a low mains voltage (198 V) is not possible, but that a certain time period elapses, which is not acceptable with the use of such lamps in many fields of application, more particularly, for example, in the domestic field.

It is further known from DE-PS No. 622171 and U.S. Pat. No. 3,890,537 to cause the lamp to be acted upon by a considerably increased starting current in order to improve the starting properties—more particularly in order to avoid an excessively long glow stage. This increased current flow takes place at least for about a mains half cycle, but mostly even for a considerably longer time. In the case of a choke coil, such an increased current can flow through a path parallel to the choke, whose a.c. impedance is comparable with or smaller than that of the choke. If this parallel path is constructed with a correspondingly large capacitor, the passage from the glow discharge to the arc discharge is improved, it is true, but at the subsequent zero passages reignition difficulties are met, which lead to extinguishing of the lamp. This appears from a lecture delivered during the "Third International Symposium on the Science and Technology of Light Sources" in Toulouse from 18 to 21 April 1983 by Mr. van Vliet about "Ignition of gas discharge lamps", in which the circuit arrangement mentioned in the opening paragraph was disclosed, in which the choke coil is shunted by a resistor or a large capacitor.

SUMMARY OF THE INVENTION

Therefore, the invention has for an object to provide a circuit arrangement for igniting and operating gas discharge lamps having a choke coil shunted by a capacitor, in which no reignition problems occur at the current zero passage and which nevertheless permits of obtaining a reliable ignition of the lamp both in the cold and in the hot state.

According to the invention, this object is achieved in a circuit arrangement of the kind mentioned in the opening paragraph in that the capacitor has a capacitive reactance $1/\omega c > 3\omega L$, where $\omega$ is the angular frequency of the a.c. mains.

Surprisingly, it has been found that for improving the starting properties it is not necessary—as according to the prior art—to cause an increased current to flow through the lamp, at least during the part of the half cycle following the lamp ignition. It is rather sufficient if, during the ignition process, a considerably increased current flows only for a fraction of the half cycle.

Even if the a.c. impedance of the capacitor is considerably larger than the impedance of the choke coil, nevertheless during the ignition process a high, but transient charge current pulse can flow through the capacitor and hence through the lamp, which pulse is sufficient to obtain a reliable ignition of the lamp. During normal operation, on the contrary, only a small current flows through the capacitor. Thus, the lamp can also be started with an increased luminous flux, this starting stage being moreover further shortened.

In order to avoid unfavourable effects of an excessively high capacitor charge current on the lamp or other circuit parts, according to a further embodiment of the invention, an ohmic resistor having a value R is connected in series with the capacitor, the RC time constant of this series arrangement lying between 10 $\mu$s and 1 ms. The RC time constant is chosen so that the pulsatory charge times of the capacitor do not become too short. Too short charge times in fact would deteriorate the ignition behaviour of the lamp. Since short charge times require very high peak currents, they could moreover cause the lamp to emit infrared radiation, which could lead to interference with remote control arrangements operating with infrared radiation.

In order that the capacitor be discharged with a non-ignited lamp, which is advantageous for a subsequent ignition, according to a further favourable embodiment of the invention, a further ohmic resistor is connected in parallel with the capacitor, which resistor has such a value $R_{zus}$ that its discharging time constant $R_{zus}$.C lies between 0.05 and 20 ms. The resistance value $R_{zus}$ is again larger than the impedance of the choke coil.

In order to avoid a possible overload and to obtain a saving of energy, the passive circuit element(s) arranged in the current path parallel to the choke coil can be switched off after ignition of the lamp. Preferably, the current path parallel to the choke coil includes a switch which is opened after ignition of the lamp. This switch may be a bimetal switch or a part of a switching relay arranged in the main current circuit of the lamp. However, these switches do not operate very rapidly. Moveover, due to the high lamp ignition current their contacts are subjected to wear in due course. Therefore, it is more advantageous to use as switches semiconductor switching elements which operate rapidly and do not require any maintenance, such as, for example, transistors, triacs or thyristors.

BRIEF DESCRIPTION OF THE DRAWINGS

In order that the invention may be readily carried out, it will now be described more fully, by way of example, with reference to the accompanying drawing, in which.

DESCRIPTION OF THE PREFERRED EMBODIMENTS

Figure 1:
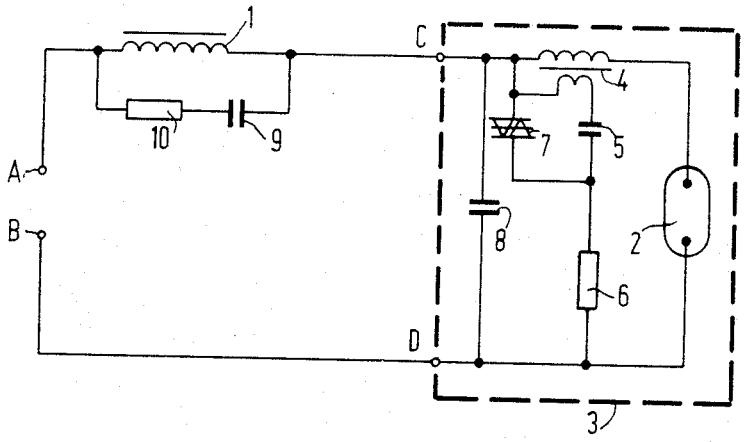
FIG. 1 shows a circuit arrangement for igniting and operating a gas discharge lamp having a choke coil which is shunted by a capacitor connected in series with a resistor.

Input terminals for connection to an a.c. mains of, for example, 220 V, 50 Hz are designated by A and B. Through a choke coil 1 a gas discharge lamp 2 is connected to the input terminals. The circuit part behind the connection terminals C and D is the actual ignition device 3 of the lamp 2, which may advantageously be integrated in the lamp base. This ignition device 3 comprises a high-voltage transformer 4, whose secondary winding is connected between the choke coil 1 and the lamp 2. A blocking capacitor 5 is connected in series with a charge resistor 6 to one side of the primary winding of the high-voltage transformer 4. The other side of the primary winding is connected to a symmetrically switching four-layer diode 7 (Sidac) (c.f. U.S. Pat. No. 3,866,088), whose other side is connected to the junction between the blocking capacitor 5 and the charge resistor 6. A high-frequency return capacitor 8 is connected in parallel with this circuit. The ignition device 3 described operates as a super heterodyne igniter and can be accommodated in the base of the lamp 2. The primary ionization of the gas mixture in the lamp 2 for initiating the ignition process is initiated by the ignition pulses produced by the ignition device 3.

The ignition pulses are obtained in the following manner:

Via the charge resistor 6, the blocking capacitor 5 is charged. As soon as the latter has reached a voltage which lies above the breakdown voltage of the Sidac 7, it switches to its low-ohmic position so that the blocking capacitor 5 is discharged through the primary winding of the high-voltage transformer 4. As a result, a high-voltage pulse is produced in the secondary winding of the transformer 4, which pulse reaches the lamp 2 via the high-frequency return capacitor 8. After the blocking capacitor 5 has been discharged, the Sidac 7 again becomes non-conductive. The charge resistor 6 and the breakdown voltage of the Sidac 7 are chosen so that about one to five ignition pulses occur near the maximum of the mains alternating voltage. As soon as the lamp 2 has definitely ignited, the voltage between the terminals C and D falls to the lamp voltage so that the breakdown voltage of the Sidac 7 is no longer reached and further ignition pulses do not occur.—In practice, the high-frequency return capacitor 8 may be kept very small and may frequently even be dispensed with because the path comprising the blocking capacitor 5 and the charge resistor 6 may also serve as a high-frequency return lead.

The inductance of the choke coil 1 is chosen so that in normal operation, i.e. after the lamp 2 has been heated, the nominal lamp current flows. When due to the high-voltage pulse produced by the ignition device 3 a primary ionization occurs in the lamp, current can flow through the choke coil 1 to the lamp 2. However, since this current is limited by the inductance L of the choke coil 1 to about the nominal lamp current, and moreover the rate of increase of the current through the choke coil is also limited, this is in many cases in itself not sufficient to provide a reliable ignition of the lamp 2. Therefore, a current path comprising a capacitor 9 in series with an ohmic resistor 10 is arranged in parallel with the choke coil 1. The capacitance C of the capacitor 9 is chosen so that its reactance for the frequency of the a.c. mains is a few hundred Ω to a few kΩ (in accordance with the coil size) and hence is high with respect to the impedance of the choke coil ($1/\omega c > 3\omega L$). Consequently, in normal operation of the lamp 2, only a small current can flow in the parallel current path that includes the capacitor 9. During ignition of the lamp, however, a high charge current transiently flows through the capacitor 9 and hence through the lamp 2. This short charge current is sufficient to ignite the lamp 2. The resistor 10 connected in series with the capacitor 9 serves to limit the charge current in order to avoid unfavourable effects of an excessively high charge current on the lamp 2 or on other circuit parts. For this purpose, the value R of the ohmic resistor 10 is chosen so that the RC time constant lies between 10 μsec and 1 msec so that the pulsatory charge times of the capacitor 9 are sufficiently long.

Figure 2:
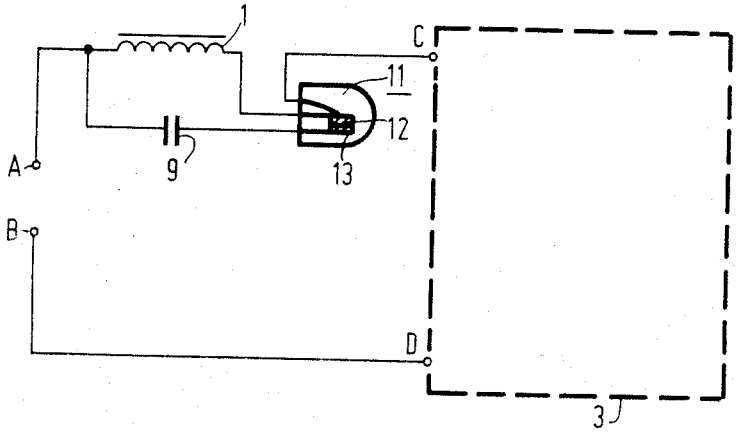
FIG. 2 shows the choke part of a circuit arrangement for igniting and operating gas discharge lamps, in which the choke coil is shunted by a capacitor connected in series with a bimetal switch.

In the circuit arrangement shown in FIG. 2, the path parallel to the choke coil 1 solely comprises a capacitor 9, which can be switched off by means of a bimetal switch 11. In the cold state, the contacts 12 and 13 of the bimetal switch 11 are closed so that the capacitor 9 is connected in parallel with the choke coil 1 and its charge current produces an ignition pulse for the lamp 2, as has been described with reference to FIG. 1. After ignition of the lamp 2, the bimetal strips of the bimetal switch 11 are heated by the current flowing through them, as a result of which the contacts 12 and 13 are opened. Consequently, the parallel current path is interrupted so that the lamp 2 is supplied with its normal current solely via the choke coil 1.

Figure 3:
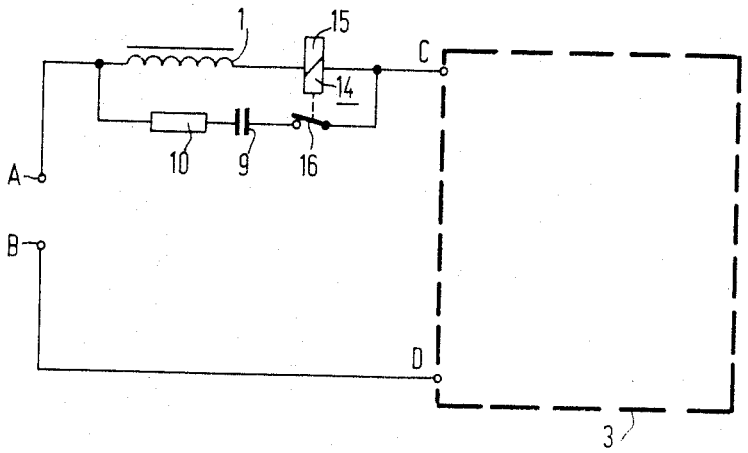
FIG. 3 shows a choke part similar to that of the circuit arrangement shown in FIG. 1 having an additional switching relay.

Bimetal switches require a given time period for closing after the lamp has been extinguished. During this time period, the current path parallel to the choke coil is consequently not yet closed again so that a reliable reignition of the still hot lamp is not always guaranteed. This disadvantage can be avoided if instead of a bimetal switch a switching relay 14, as shown in FIG. 3, is used. The relay coil 15 is arranged in series with the choke coil 1 in the main current circuit of the lamp 2. The actual relay switch 16 is arranged in the current path parallel to the choke coil 1 in series with the capacitor 9 and the ohmic resistor 10. The ignition of the lamp takes place in the manner described with reference to FIG. 1. After ignition of the lamp, such a high lamp current flows through the relay coil 15 that it is excited and opens the relay switch 16.

Figure 4:
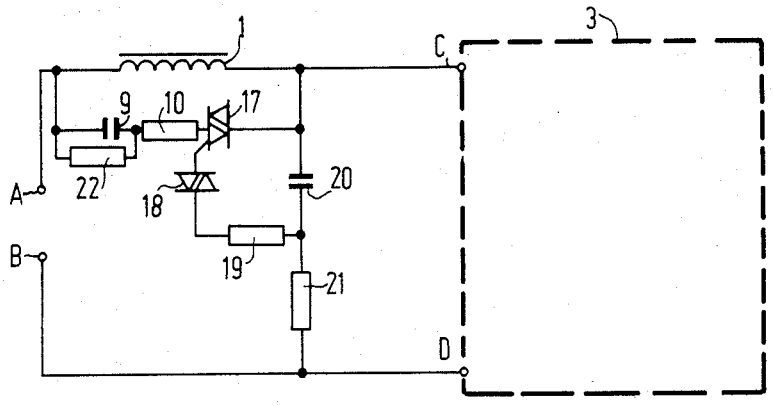
FIG. 4 shows a choke part in which the passive circuit elements arranged in parallel with the choke coil can be switched off by means of a semiconductor switching element.

FIG. 4 shows a circuit arrangement having a switching element which operates at an even higher speed. The path parallel to the choke coil 1 comprises the capacitor 9, the ohmic resistor 10 and a triac 17. The gate electrode of the triac 17 is connected through a trigger diode 18 and a protective resistor 19 to a capacitor 20, which is charged through a resistor 21. If the voltage of the capacitor 20 exceeds the breakdown voltage of the trigger diode 18 of about 30 V, the trigger diode becomes conductive and thus the triac 17 is also switched to its conductive state. By a corresponding choice of the resistor 21, it can be achieved that the decay instant of the triac 17 lies before the response instant of the ignition device 3 so that during the ignition process an increased current can flow through the lamp 2. As soon as the lamp has been definitely ignited, only the lamp voltage, which is considerably lower than the mains alternating voltage, is still applied across the series arrangement of the resistor 21 and the capacitor 20. Therefore, the capacitor 20 can no longer be charged to the breakdown voltage of the trigger diode 18 so that the triac 17 remains cut off.

In order to discharge the capacitor 9 when the lamp 2 is extinguished, in the circuit arrangement shown in FIG. 4 a further ohmic resistor 22 is connected in parallel with the capacitor 9 and the value $R_{zus}$ of this resistor is chosen so that the discharge time constant $R_{zus}$.C lies between 0.05 and 20 msec. As a result, a next ignition of the lamp is facilitated because otherwise under given conditions too small a charge current flows.

Figure 5:
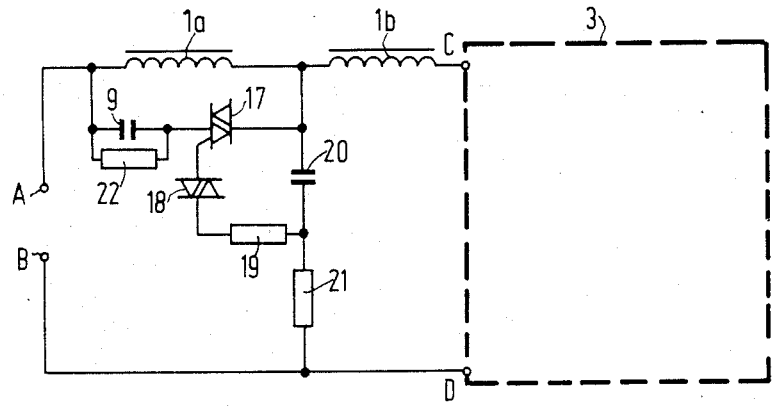
FIG. 5 shows a choke part similar to that shown in FIG. 4 in which the choke coil is divided into two subcoils.

In the circuit arrangement shown in FIG. 5, in contrast with that of FIG. 4, the choke coil is subdivided into two parts 1*a* and 1*b*, the parallel current path with the parallel arrangement of the capacitor 9 and of the further ohmic resistor 22 in series with the triac 17 is solely connected in parallel with the choke coil part 1*a*. The choke coil part 1*b* is permanently arranged in the main current circuit of the lamp 2.

Typical data of the elements used in the embodiments are, for example:

| | |
|---|---|
| capacitor 5: | 0.05 μF |
| capacitor 8: | 0.01 μF |

-continued

| | |
|---|---|
| capacitor 9: | 1 μF |
| capacitor 20: | 0.02 μF |
| resistor 6: | 12 kΩ |
| resistor 10: | 70 Ω |
| resistor 19: | 27 Ω |
| resistor 21: | 60 kΩ |
| resistor 22: | 1 kΩ |
| choke coil 1: | 0.5 Hy |
| Sidac 7: | K1V26 of Shindengen Company |
| trigger diode 18: | BR100 of Valve Company |
| Triac 17: | IT812M of ITT Company. |

The high-voltage transformer 4 did not comprise a core and had a transmission ratio of 1:60. Of course, transformers having a core and embodiments in the form of an autotransformer may alternatively be used.

Even at a mains voltage of only 200 V, a reliable cold start of 70 W sodium high-pressure lamps could be attained with these elements, more particularly with the circuit arrangements shown in FIGS. 1, 4 and 5. Moreover, a reignition of the still hot lamp was possible after about 3 seconds. If, on the contrary, in the known circuit arrangements described in DE-OS Nos. 3108547 and 3108548 elements and ignition voltages of the same order of magnitude were used, a time period of more than 15 seconds elapsed before the reignition. However, in many applications such a time period is not acceptable.

Finally, it should be noted that the igniter used need not necessarily be a superheterodyne igniter, but other types, such as, for example, an antenna igniter (cf. DE OS No. 3109539) may also be considered.

What is claimed is:

1. A circuit arrangement for igniting and operating gas discharge lamps comprising: a choke coil connected between a lamp and an a.c. supply source and having an inductance L, an ignition device connected to the lamp, a capacitor having a capacitance C connected in parallel with at least a part of the choke coil in order to pass an ignition current to the lamp that is higher than the normal lamp operating current, characterized in that the capacitor has a capacitive reactance that lies in a range between a minimum capacitive reactance of 3 times the choke coil inductive reactance and a capacitive reactance of approximately 20 times the choke coil inductive reactance.

2. A circuit arrangement for igniting and operating gas discharge lamps comprising: a choke coil connected between a lamp and an a.c. supply source and having an inductance L, an ignition device connected to the lamp, a capacitor having a capacitance C connected in parallel with at least a part of the choke coil in order to pass an ignition current to the lamp that is higher than the normal lamp operating current, characterized in that the capacitor has a capacitive reactance $1/\omega c > 3\omega L$ and that an ohmic resistor having a resistance value R is connected in series with the capacitor, the RC time constant of the resistor and capacitor lying between 10 μsec and 1 ms.

3. A circuit arrangement as claimed in claim 2, characterized in that a further ohmic resistor is connected in parallel with the capacitor, said further resistor having a resistance value $R_{zus}$ such that the discharge time constant $R_{zus}$.C lies between 0.05 and 20 ms.

4. A circuit arrangement as claimed in claim 2 further comprising switching means connected so that the passive element(s) arranged in the current path parallel to the choke coil can be switched off after ignition of the lamp.

5. A circuit arrangement as claimed in claim 4, characterized in that the switching means comprises a switch in the current path parallel to the choke coil, said switch being opened after ignition of the lamp.

6. A circuit arrangement as claimed in claim 5, characterized in that the switch is a bimetal switch.

7. A circuit arrangement as claimed in claim 5, characterized in that the switch forms part of a switching relay arranged in the main current circuit of the lamp.

8. A circuit arrangement as claimed in claim 5, characterized in that the switch is a semiconductor switching element.

9. A circuit for igniting and operating a discharge lamp comprising: a pair of input terminals for connection to an alternating current supply, a ballast inductor having an inductance L, means for connecting the ballast inductor in series circuit with a lamp across said pair of input terminals, a lamp ignition device and means for coupling the ignition device to a lamp, a capacitor having a capacitance C, means connecting the capacitor in parallel with at least a part of said ballast inductor to provide a parallel current path for passing an ignition current to the lamp that is higher than the normal lamp operating current, the capacitive reactance of the capacitor at the AC supply frequency being at least 3 times greater than the inductive reactance of the ballast inductor, and a resistor having a resistance value $R_Z$ connected in parallel with the capacitor to provide a discharge path therefor, the discharge time constant $R_ZC$ of the resistor and capacitor lying between 0.05 ms and 20 ms.

10. A circuit as claimed in claim 9 further comprising switching means connected in circuit so as to switch off the circuit elements in said parallel current path after ignition of the lamp.

11. A circuit as claimed in claims 9 or 10 further comprising a second resistor connected in series with the capacitor and having a resistance value R, the RC time constant of the second resistor and the capacitor lying between 10 μsec. and 1 ms.

* * * * *